US008551222B2

(12) United States Patent
Fisenko

(10) Patent No.: US 8,551,222 B2
(45) Date of Patent: Oct. 8, 2013

(54) APPARATUS FOR COMBUSTION PRODUCTS UTILIZATION AND HEAT GENERATION

(75) Inventor: Vladimir Vladimirovich Fisenko, St. Petersburg (RU)

(73) Assignee: Fisonic Holding Limited, Cyprus (CY)

( * ) Notice: Subject to any disclaimer, the term of this patent is extended or adjusted under 35 U.S.C. 154(b) by 0 days.

(21) Appl. No.: 13/315,278

(22) Filed: Dec. 8, 2011

(65) Prior Publication Data

US 2012/0145050 A1 Jun. 14, 2012

Related U.S. Application Data

(60) Provisional application No. 61/421,061, filed on Dec. 8, 2010.

(51) Int. Cl.
*B01D 53/14* (2006.01)

(52) U.S. Cl.
USPC ..... 95/216; 96/322; 96/175; 96/275; 96/323; 261/DIG. 54; 95/227

(58) Field of Classification Search
None
See application file for complete search history.

(56) References Cited

U.S. PATENT DOCUMENTS

| | | | | | |
|---|---|---|---|---|---|
| 2,887,390 | A * | 5/1959 | Coulter et al. | ..... | 426/588 |
| 3,049,574 | A * | 8/1962 | Johnson | ..... | 585/380 |
| 3,081,257 | A * | 3/1963 | Johnson et al. | ..... | 208/133 |
| 3,185,740 | A * | 5/1965 | Malick | ..... | 585/380 |
| 3,537,650 | A * | 11/1970 | Peczeli et al. | ..... | 239/405 |
| 3,576,384 | A * | 4/1971 | Peczeli et al. | ..... | 431/353 |
| 3,756,575 | A * | 9/1973 | Cottell | ..... | 261/1 |
| 4,338,099 | A * | 7/1982 | Crouch et al. | ..... | 48/197 R |
| 4,439,401 | A * | 3/1984 | Voll et al. | ..... | 422/150 |
| 4,728,285 | A * | 3/1988 | Kamelreiter et al. | ..... | 431/187 |
| 5,672,187 | A * | 9/1997 | Rock et al. | ..... | 95/219 |
| 6,986,471 | B1 * | 1/2006 | Kowalsky et al. | ..... | 239/79 |
| 2008/0230632 | A1 * | 9/2008 | Fenton et al. | ..... | 239/433 |

* cited by examiner

*Primary Examiner* — Duane Smith
*Assistant Examiner* — Pankti Patel
(74) *Attorney, Agent, or Firm* — Novak Druce Connolly Bove + Quigg LLP; Jonathan A. Jaech

(57) ABSTRACT

A method and apparatus for heating a fluid and treating a combustion products waste stream includes two or more nozzles discharging into a mixing chamber, and an outlet of the mixing chamber discharging to a gas-liquid separator. A liquid output of the gas-liquid separator may be treated to remove carbonaceous or other impurities. The nozzles may include an annular nozzle, Fisenko nozzle, and/or Laval nozzle arranged in a transonic jet module. A heated input liquid may be accelerated to sonic velocity in a main nozzle, causing boiling due to pressure drop prior to mixing with a combustion product stream in the mixing chamber. Heat may be recovered from a mixture discharged from the mixing chamber. Carbonic, sulfuric, or other combustion impurities may be captured by dissolving in water or other solvent in the transonic jet module and then recovered or otherwise used in a liquid stream from the separator.

10 Claims, 5 Drawing Sheets

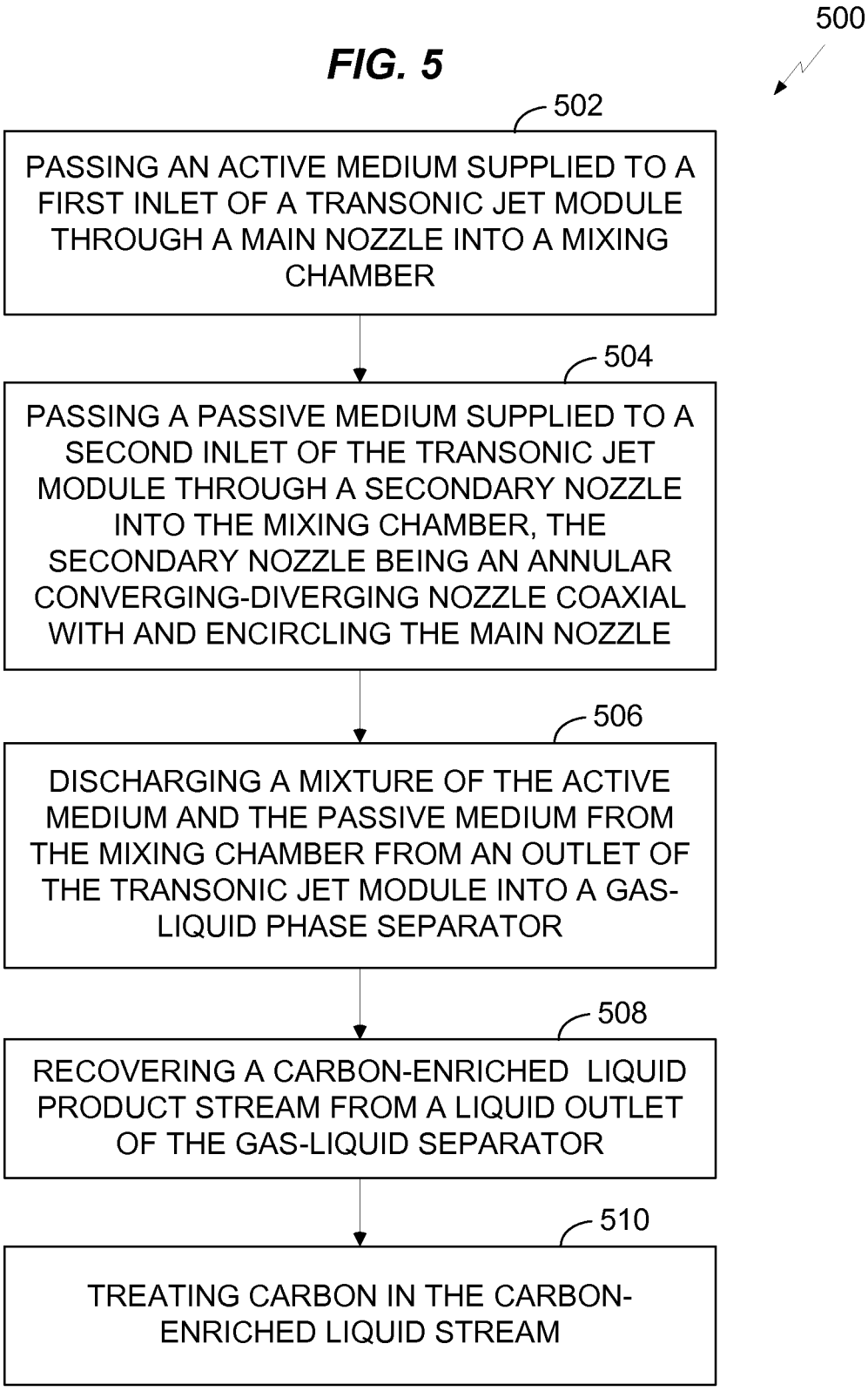
500
FIG. 5
502
PASSING AN ACTIVE MEDIUM SUPPLIED TO A FIRST INLET OF A TRANSONIC JET MODULE THROUGH A MAIN NOZZLE INTO A MIXING CHAMBER
504
PASSING A PASSIVE MEDIUM SUPPLIED TO A SECOND INLET OF THE TRANSONIC JET MODULE THROUGH A SECONDARY NOZZLE INTO THE MIXING CHAMBER, THE SECONDARY NOZZLE BEING AN ANNULAR CONVERGING-DIVERGING NOZZLE COAXIAL WITH AND ENCIRCLING THE MAIN NOZZLE
506
DISCHARGING A MIXTURE OF THE ACTIVE MEDIUM AND THE PASSIVE MEDIUM FROM THE MIXING CHAMBER FROM AN OUTLET OF THE TRANSONIC JET MODULE INTO A GAS-LIQUID PHASE SEPARATOR
508
RECOVERING A CARBON-ENRICHED LIQUID PRODUCT STREAM FROM A LIQUID OUTLET OF THE GAS-LIQUID SEPARATOR
510
TREATING CARBON IN THE CARBON-ENRICHED LIQUID STREAM

APPARATUS FOR COMBUSTION PRODUCTS UTILIZATION AND HEAT GENERATION

CROSS-REFERENCE TO RELATED APPLICATION

This application claims priority pursuant to 35 U.S.C. §119 (e) to U.S. provisional application Ser. No. 61/421,061, filed Dec. 8, 2010, which is hereby incorporated by reference, in its entirety.

BACKGROUND

1. Field

This application relates to methods and systems for combustion products utilization and heat generation using multiple nozzles. The methods and systems may be used, for example, in heat engineering and ecological technologies, such as apparatus for heat energy generation from hydrocarbon fuel (liquid and gaseous) as used in systems of water heating and apparatus for hazardous waste processing of combustion products or the like.

2. Description of Related Art

A known unit for generation of heat from hydrocarbon fuel to heat a water medium comprises a gas-liquid jet device, equipped with: a main nozzle and water inlet connected to the heat carrier (water) outlet in a combustion system; an inlet for combustion products in form of a vapor-gas-water mixture; a blending chamber; a combustion chamber, equipped with a water outlet, connected to the heat carrier outlet of the combustion system; a fuel nozzle and outlet connected to the combustion products inlet of the gas-liquid jet device; a separator, equipped with an inlet connected to the gas-liquid jet device outlet; a water outlet connected to the inlet of the heat consumption system; and a gas outlet, as described in Russian patent application RU2202055 C2, IPC7 F04F5/54, published Apr. 10, 2003 by the inventor hereof.

The stated known technical solution accepted as a prototype ensures heating of the water heat carrier and its supply to a heating system, but is subject to certain disadvantages. Firstly, the apparatus produces environmental pollution in the form of waste gases such as exiting from the separator. Secondly, the apparatus is not effective for high rates of thermal heating due to providing only relatively low fuel consumption per unit of generated heat power.

Accordingly, it would be desirable to provide a design of an apparatus for heat generation from hydrocarbon fuels, capable of providing a substantial reduction in specific fuel consumption and minimizing environmental pollution in the form of waste gases.

SUMMARY

Methods and apparatus for processing combustion residue to remove impurities and generate heat, that overcome the limitations of the prior art. A reduction in specific fuel consumption and minimizing carbon dioxide or pollutant discharge into the atmosphere may be achieved, using the disclosed technology.

In an aspect, an apparatus includes a multi-nozzle transonic jet module (TJM) coupled to discharge to a gas-liquid separator. Each TJM may be supplied with two inlets, for active and passive medium accordingly, a main nozzle connected from the inlet to the inlet for active medium, and an annular nozzle (the second nozzle) connected from its inlet to the inlet for passive medium. Each TJM may further include a chamber for mixing streams on the outlets from the main and annular nozzles. The annular nozzle may be coaxial with the main nozzle. In another aspect, the annular nozzle may encircle the main nozzle ad converge from its inlet section to a throat of minimal cross-section, from where it may diverge in an outlet section.

Various methods of using the apparatus, and variations on the apparatus, are also disclosed. In an aspect, the active medium supplied to the main nozzle of the TJM may comprise hot combustion products from combustion of hydrocarbons, such as petroleum products or coal, and the passive medium supplied to the annular nozzle may comprise water, which may be heated prior to be introduced to the TJM. In the alternative, the active medium supplied to the main nozzle of the TJM may comprise water (which may be pre-heated), and the passive medium supplied to the annular nozzle may comprise hot combustion products.

In another aspect, the gas-liquid separator may be in the form of a cyclone and supplied with via an inlet connected to an outlet of a TJM as described herein. The separator may comprise liquid (e.g., water) and gas outlets, which may be connected to respective circuits for removing impurities using one or more purification techniques. Heat may be recovered for any desired application from a discharge of the TJM, using a heat exchanger or the like.

Using hot water or hot combustion products as an active medium in the TJM, heat incorporated in the active medium may be effectively transformed into kinetic energy of a gas-liquid stream formed by mixing of active and passive mediums. Kinetic energy of the stream may be used by operation of the TJM to transform a mixture of the input streams into a mist-like (misty) medium with sizes of drops smaller than the length of their free run. Such transformation advantageously may generate a very high ratio of surface area to liquid volume, to facilitate contact and exchange between liquids and gases in the misty medium. In turn, the high surface-to-volume ratio facilitates dissolution of carbon and sulfur dioxides in the liquid part of the misty medium. Subsequently, the liquid and gas fractions of the misty medium may be separated into separate liquid and gas streams. The gas stream may be purified by dissolution of carbon and sulfur in water droplets of the misty medium to form an acidic liquid discharge. The liquid output may be treated by application of alkali liquor to neutralize acid species. In addition, or in the alternative, carbon dioxide absorbed by water in the misty medium may be wholly or partially removed from liquid discharged from the gas-liquid separator, using calcium, magnesium, potassium or other reactant in a decarbonator to form a desired carbonate by-product. Thus, carbon dioxide from a carbonaceous combustion process may be prevented from being discharged into the atmosphere.

More detailed aspects of the foregoing method and apparatus, and related methods and apparatus, are described in more detail in the detailed description that follows.

BRIEF DESCRIPTION OF THE DRAWINGS

The present technology, in accordance with one or more various embodiments, is described in detail with reference to the following figures. The drawings are provided for purposes of illustration only and merely depict typical or example embodiments of the technology. These drawings are provided to facilitate the reader's understanding of the technology and shall not be considered limiting of the breadth, scope, or applicability of the technology.

FIG. 5 illustrates aspects of methods for treating a combustion exhaust stream to remove carbon dioxide or other impurities using the systems as described herein.

DETAILED DESCRIPTION

Figure 1:
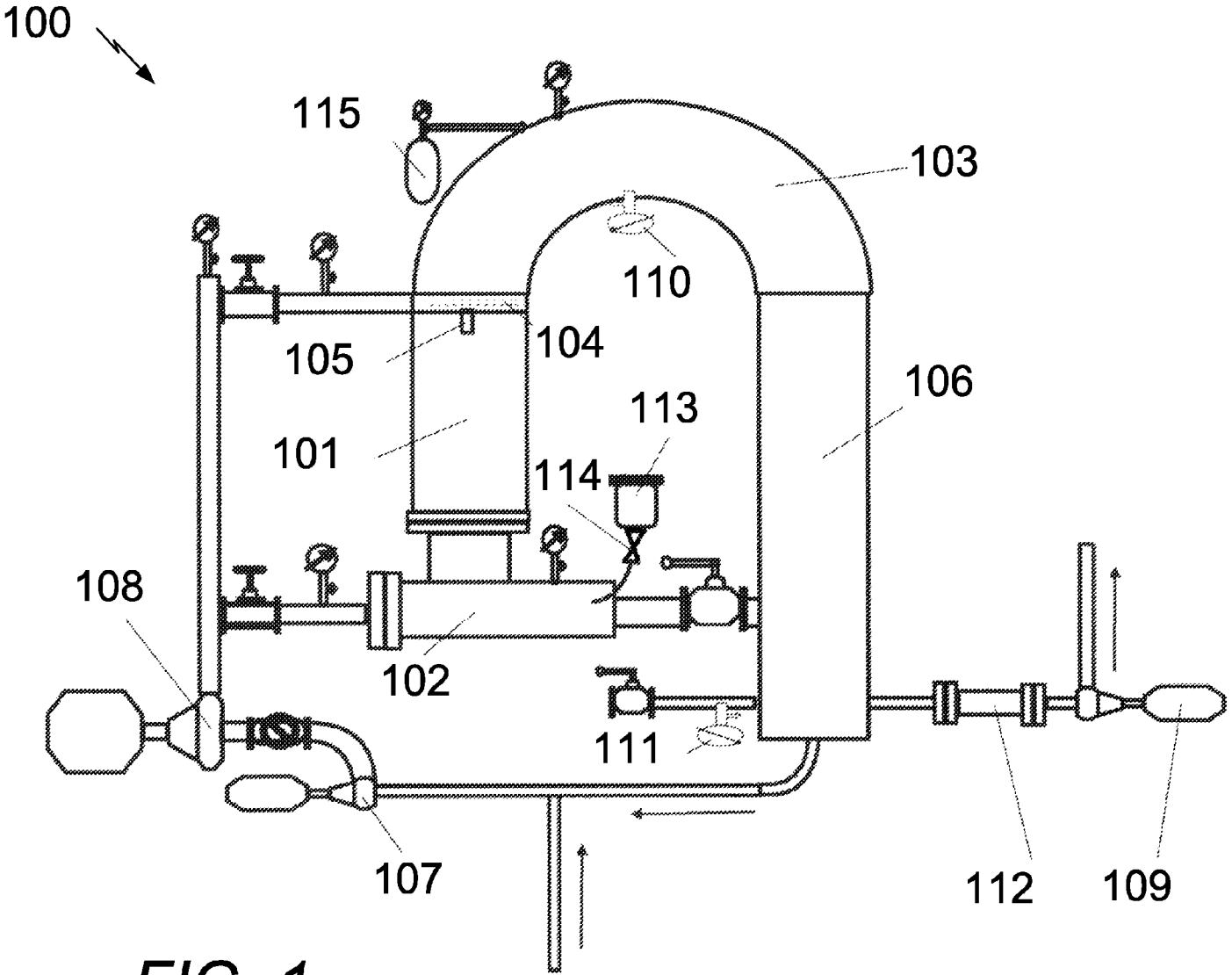
FIG. 1 is a schematic diagram showing a system for recovering impurities from combustion gases, including a TJM, separator, and other components, in which the active medium is primarily water.

An apparatus for combustion residue recovering and heat generating incorporates at least one transonic jet module with an inlet for active medium (the first inlet), an inlet for passive medium (the second inlet) and an outlet for connecting to an inlet of a gas-water phases separator for the mixture obtained from the transonic apparatus. The separator incorporates gas and water outlets, which may be coupled to processes for treating or removing harmful impurities found in gas and water phases respectively. The transonic jet module may incorporate a main nozzle connected to an inlet for receiving an active medium, a nozzle (secondary nozzle) for a passive medium, and a mixing chamber. The secondary nozzle for passive medium may be configured in the form of an annular nozzle coaxial with the main nozzle and encircling it, and narrowing from its inlet section to a throat of minimal cross section and further expanding to its outlet section.

Water may be used as an active medium, and fuel combustion residue may be used as a passive medium. Another variant, where fuel combustion residue is used as an active medium, and water is used as a passive medium, is also possible.

For the purpose of recovering harmful impurities, for example carbon and sulfur oxides found in water phase, the system may be supplied with a suitable reactor, for example, a calcium-based decarbonator, connected to the water outlet of the separator. The reactor may be supplied with a reservoir for a chemical agent, for example alkali liquor, and with a measuring valve connected to the mixing chamber of the jet module and/or to the separator.

The nozzle for the passive medium may be configured to cause transonic flow, and the separator may be configured in the form of a cyclone. As used herein, "transonic" means transitioning to a sonic flow, i.e., to a flow at the speed of sound of the working medium.

In some embodiments, where water is used as the active medium, an active medium inlet of the transonic jet module may be coupled to the reverse line ("return") of a heat supply system (e.g., a heater). In such embodiments, the separator may be configured for coupling its water outlet to an inlet of the heat-supply system.

In this variant (with water as the active medium) the main nozzle may be configured in the form of the Fisenko nozzle, which includes an inlet convergent and an outlet divergent along the medium flow sections. Accordingly, the inlet section may be configured with multistage draw-down of the inner diameter with possibility of boiling of a part of the stream. A geometric profile of the divergent outlet section of the nozzle may be formed by the part of a concave towards the axis of the nozzle part of the curve transitioning smoothly into a convex part. In addition, a critical section of the nozzle where the stream velocity is equal to the sound velocity may be located in the outlet section of the nozzle. An optimal result may be reached under conditions when the smooth and continuous transition of the concave part into the convex part is located in a critical section of the nozzle, where the second-order derivative of the section area along the nozzle length is equal to zero.

Further, the transonic jet module may be provided with a sharp edge located in the inlet section. The concave part of the outlet section of the main nozzle may be provided with a profile of its initial part characterized by sudden enlargement of its diameter from the inlet of the outlet section of the nozzle along the stream flow, such that the first-order derivative from the area of the cross-section of the outlet part on coordinate along the axis has a maximum value on the inlet to the concave part. The profile of the outlet section of the main nozzle in the transonic jet module may be configured close to the form of the stream profile calculated according to equation of reversible adiabatic expansion into an open space, using the current thermodynamic parameters of the stream for the set input parameters of temperature and pressure and the adiabatic index $k_p$ for the stream in the form of a homogenous two-phase mixture. Accordingly, the adiabatic index $k_p$ characterizes gas-liquid, for example a vapor-water mist-like medium, the sizes of particles of which are smaller than the length of their free run and determined from the relationship $$k_p = 0.592 + \frac{0.7088}{\beta_p},$$

where $0.5<\beta_p<1$ characterizes the volume ratio of gaseous phase in the flow of gas-liquid (vapor-water) medium in the critical section of the nozzle.

The transonic jet module of the applied apparatus may include an additional nozzle coupled to the mixing chamber. The additional nozzle may be configured in the form of the Fisenko nozzle of the above-described concave-convex design. Namely, it includes an inlet section configured in the form of a cylindrical channel connected to the outlet divergent section. The outlet section has geometric profile formed by the part of a concave towards the axis of the nozzle part of the curve transitioning smoothly into a convex profile. The critical section of the nozzle where the stream velocity is equal to the sound velocity may be located in the outlet section of the nozzle. Further the outlet section of the additional nozzle of the transonic jet module may include an outlet cylindrical part connected to the convex part of the outlet section. An optimal result may be reached by locating the continuous transition of the concave part into the convex part at the critical section of the nozzle, where the second-order derivative of the section area along the nozzle length is equal to zero. The cylindrical part of the additional nozzle may have a length of 0.5 to 1 its diameter.

In addition, a positive effect on achievement of the result may be provided by a sharp edge in the transonic jet module; the sharp edge may be located in a zone connecting of the mixing chamber to the cylindrical channel; and also by configuring the concave part of the outlet section of the additional nozzle with the profile of its initial part characterizing by sudden enlargement of its diameter from the inlet of the outlet section of the nozzle along the stream flow. Accordingly, the first-order derivative from the area of the cross-section of the outlet part on coordinate along the axis may be provided with a maximum value on the inlet to the concave part.

In another aspect, the profile of the outlet section of the additional nozzle may be configured close to the form of the stream profile calculated according to equation of reversible adiabatic expansion of the stream from a cylindrical nozzle into an open space, using current thermodynamic parameters of the stream for the set input parameters of temperature and pressure and with account of the adiabatic index $k_p$ for the stream in the form of a homogenous two-phase mixture, which prevails in composition of mixed water medium and gaseous discharge incorporating harmful impurities, for example end products of fuel combustion. In this case the adiabatic index $k_p$ characterizes gas-liquid (including vapor-water) mist-like medium, the sizes of particles of which are smaller than the length of their free run and determined from the relationship $$k_p = 0.592 + \frac{0.7088}{\beta_p},$$

where $0.5<\beta_p<1$ characterizes the volume ratio of gaseous phase in the flow of gas-liquid (vapor-water) medium in the critical section of the nozzle.

In variant of the apparatus execution with the additional nozzle having profile of the Fisenko nozzle, a Laval nozzle may be used as the main nozzle.

The applied apparatus may include the second transonic jet module with the above-mentioned variant of its execution (wherein the main nozzle is a Laval nozzle and the additional nozzle a Fisenko nozzle). In this embodiment, the second transonic jet module may be connected to the separator opposite to a first TJM and arranged to cause unidirectional rotation of streams from the first and second TJM. Further, the separator may incorporate a heat exchanger connected to the independent circuit for heating a heat exchange medium flowing through it and cooling the gas/liquid mixture being processed by the separator.

Further, an apparatus according to the present technology may be supplied with an oxygen source connecting to the inlet of the combustion chamber. The oxygen source may be configured in the form of an oxygen container.

A heat consumption system may be configured either in the form of a hot-water radiator or in the form of a heat exchanger for water heating of a hot-water supply system, or in the form of a heat exchanger of a hot-water heating system, or in the form of a heat exchanger of a hot-water heating system.

In accordance with the foregoing, and more particularly to embodiments using a third or additional nozzle coupled to an outlet of the TJM mixing chamber, an example of an apparatus 100 using water as an active medium is shown in FIG. 1. The apparatus 100 may include a combustion chamber 101, a transonic gas-liquid jet module 102, a gas path or channel 103, a perforated collector 104, a fuel spray nozzle 105, a separator configured in the form of a cyclone 106, pumps 107, 108 and 109, a regulator 110 incorporating a variable valve, an automatic valve 111, a calcium-based decarbonator 112, a reservoir 113 with an alkali liquor, a measuring valve 114, and an oxygen container 115.

The combustion chamber 101 may be configured mainly cylindrical and may have a water inlet connected through the pumps 107 and 108 to the heat carrier outlet from the heat consumption system; the inlet may be configured in the form of an annual perforated collector 104 for feeding water in the sprayed state along the walls of the combustion chamber 101. Further the combustion chamber 101 may include a fuel spray nozzle 105, and an outlet connected to the inlet of the jet module 102 for combustion products, which are vapor-gas-water mixture.

Figure 2:
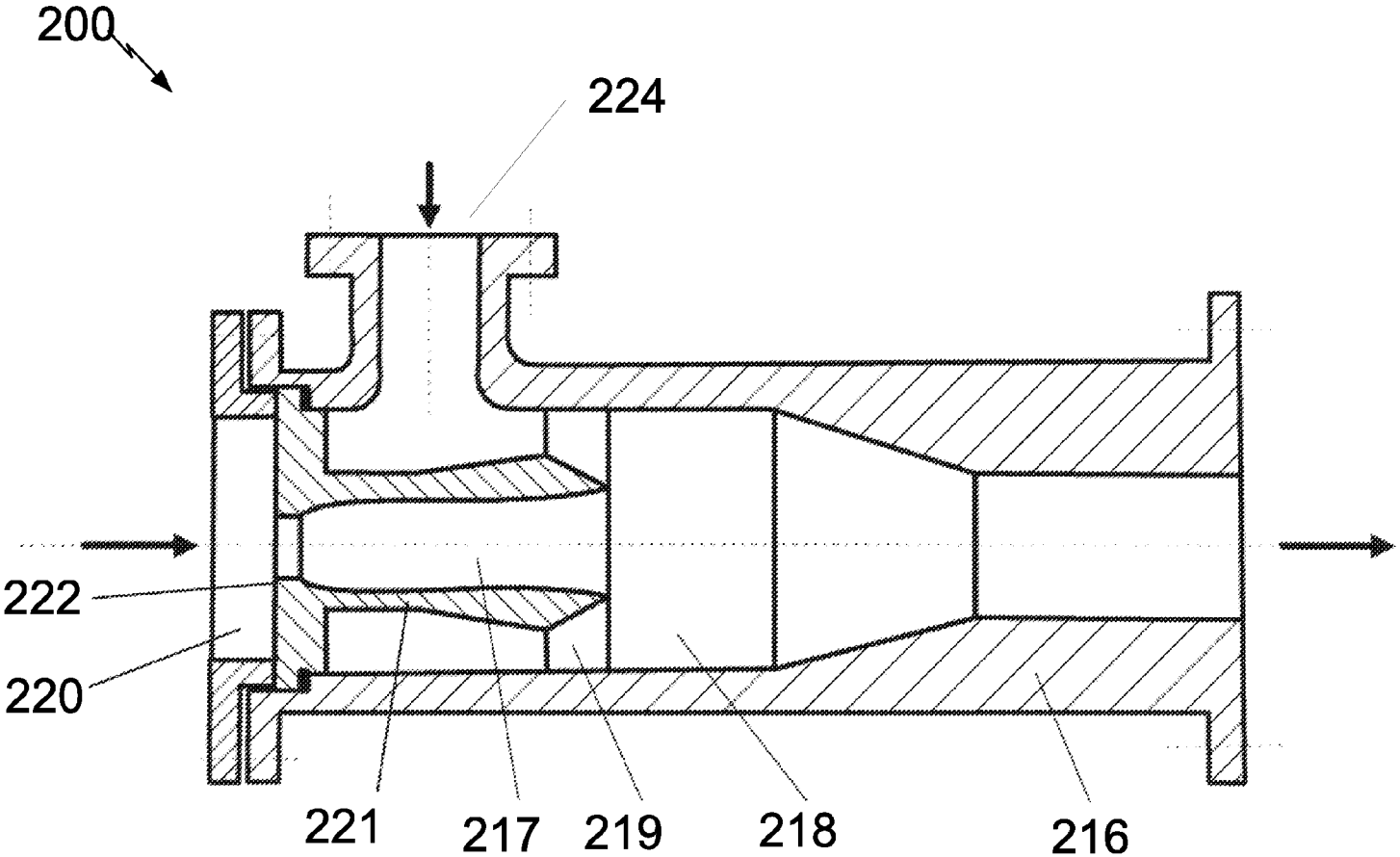
FIG. 2 shows a longitudinal section of a transonic jet module with a main nozzle in the form of a Fisenko nozzle, for use with the system shown in FIG. 1.

Referring to FIG. 2, the jet module 200 (corresponding to module 102 in FIG. 1) may include a main (water) nozzle 217 configured in a casing 216 and having a water inlet connected to the heat carrier outlet from the heat consumption system. The jet module 200 may include an inlet 224 for combustion products and a mixing chamber 218. The inlet 224 for combustion products may lead to a transonic annular nozzle 219 coaxial with the main nozzle 217 and encircling it. The nozzle 219 narrows from its inlet section to a throat of minimal diameter and further expands to its outlet section.

The main nozzle 217 may include a narrowing section 222 configured with multistage draw-down of the diameter and an outlet divergent section 221 with a geometric profile formed by the part of a concave towards the axis of the nozzle part of the curve transitioning smoothly into a convex profile portion. The nozzle 217 may also have a sharp edge 222 located in the inlet section.

Referring again to FIG. 1, the cyclone 106 may have an inlet connected to the outlet of the jet module 200, a water outlet connected to a heat carrier inlet of a heat consumption system, and a gas outlet, through which the gas path 103 may be connected to the inlet to the combustion chamber 101. The oxygen container 115 may be connected to the gas path 103.

FIG. 1 also shows a straight pipe for feeding water into the heat consumption system, a reverse pipe ("return") for water return from the heat consumption system, a launch line connecting the cyclone 106 with the inlet of the jet module 102 through the pumps 107 and 108, and a pipe for water feeding into the cyclone 106 providing additional water supply.

The apparatus according to the present invention in variations represented in FIGS. 1 and 2 may operates as follows. Oxygen may used as an oxidizing compound for fuel combustion in the apparatus; however, air taken from the atmosphere may also be used. In this case the amount of oxygen necessary for the apparatus launch may be fed from the oxygen container 115 to accelerate the launch.

Oxygen from the container 115 may be fed into the gas path 103, hot water may be fed into the perforated collector 104 to create a vapor-water screen along the walls of the combustion chamber 101, and fuel (gas or liquid fuel or water-fuel emulsion) may be fed to the fuel spray nozzle 105 and burnt.

The contact heating of vapor-water mixture by a gas flame may be realized in the combustion chamber 101. Accordingly, gas may be cooled to the temperature of saturated vapor with temperature of about 100° C. Vapor-gas-water mixture may be fed to the jet module 102 where it may be accelerated to the supersonic velocity in the annular nozzle 219, mixed with boiling water, which may be fed through the main nozzle 217 from the cyclone 106, then the mixture may be decelerated in the pressure sudden change on the outlet from the jet module 102 and may be fed into the cyclone 106 with subsonic velocity. A process of water boiling in the jet module 102 may occur as follows. Hot water stream with the set parameters of pressure and temperature may be fed to the inlet section 220 of the nozzle 217 in which it flows with constants in velocity and pressure before step change of the internal diameter, i.e. transition to the outlet section 21 through a cylindrical part. As a result of step narrowing in the inlet section of the nozzle, velocity of the stream increases, and pressure of water in the stream falls. This effect may be strengthened by separation of the stream from a sharp edge 222. As a result at achievement of pressure of saturation at the set temperature, boiling of the hot water stream occurs that leads to formation of two-phase vapor-water medium in narrow section. Accordingly, the stream density decreases, velocity increases and acceleration of the hot vapor-liquid stream in the inlet section of the nozzle occurs. Then the vapor-liquid stream from the inlet section may be fed to the outlet section 221 of the nozzle. In a concave part of the diverging outlet section 221 of the nozzle further increase of the vapor-liquid stream velocity occurs, and it reaches local sound velocity and is fed to a convex part of the outlet section 221 of the nozzle where further acceleration of the stream occurs.

In the beginning of the outlet section 221 of the nozzle 217 the stream represents a liquid with microscopic bubbles of vapor, which being the vapor generating centers provide volume boiling of liquid in process of pressure decrease in the two-phase stream. The outlet section 221 of the nozzle 217 may have a geometrical profile, in which the two-phase medium flows without separation of the stream from the nozzle walls. This profile may be configured approaching to the stream profile shape calculated according to equation of reversible adiabatic expansion linking the current diameter of the nozzle with the current thermodynamic parameters of the stream with account of the adiabatic index $k_p$ for the homogenous two-phase mixture. Vapor generating may be continued in the outlet section 221, because of it the density of the mixture decreases, velocity of the stream grows, and the sound velocity decreases. In some section (in critical section of the nozzle) velocity of the stream becomes equal to the sound velocity, and the stream becomes critical. Accordingly, a medium with microscopic bubbles of vapor may be transformed into the mist-like medium which sizes of particles are smaller than length of their free run. Further its expansion occurs with the supersonic velocity. On the outlet from the divergent part of the outlet section 221 of the nozzle 217 velocity reaches maximum. Therefore, the stream with supersonic velocity arrives in the outlet from the nozzle 217. Accordingly, an intensive conversion of liquid internal energy into kinetic energy of the stream occurs. Kinetic energy of the stream may be converted into heat energy in pressure sudden change which may be organized downstream the outlet section of the nozzle. For this purpose the nozzle 217 may additionally be supplied with the cylindrical part connected to the convex part of the outlet section 221. In the jet module 200 the cylindrical mixing chamber 218 acts as such a cylindrical part.

Separation of liquid and gas phases occurs in the cyclone 106. Water from the cyclone 106 may be fed to the consumer by means of the pump 109, and then the cooled water may be fed through the reverse pipe ("return") of the heat consumption system to the water nozzle of the jet module 102 and partially to the perforated collector 104. Maintaining of necessary oxygen concentration in the process of combustion may be realized by means of the regulator 110 configured in the form of variable door-valve.

In case of perfect combustion of the hydrocarbon fuel in oxygen there appear the combustion products: steam, and carbon dioxide. The following physical-chemical processes occur with combustion products.

After mixing with boiling water in the jet module 200 and deceleration in a sudden pressure change, steam formed in the process of fuel combustion may condense. Accordingly, heat of vapor generating may be released and fed to the heat consumer.

This heat of vapor generating may be an additional heat relating to the fuel lower heating value according to which efficiency of apparatuses for heat energy generating may be measured. Due to the said heat of vapor generating utilization coefficient of the fuel use in the apparatus may exceed 1.

First carbon dioxides may be partially absorbed with water in the jet module 102/200, and then may be wholly absorbed in the calcium (or other reactant) decarbonator 112. Accordingly, the absorption heat may be released as well as the heat from chemical transformation of lime into calcium carbonate. These heats may also be additional to the fuel combustion heat.

The regulator 110 maintains the preset pressure in the gas path 13. Intensity of gas emission in the jet module 102 and gas composition in the combustion chamber 101, and combustion efficiency of hydrocarbon fuel, and intensity of additional heat generation at water condensing and carbon dioxides absorption depend on this pressure. In case of overpressure discharge of excess amount of gas and some amount of steam into environment may be realized.

In case of lack of oxygen on the outlet from the combustion chamber 101 CO content increases. In this case it may be necessary to take steps for oxygen feeding increase, and if increase of oxygen feeding may be impossible to stop fuel feeding into the combustion chamber 1 and take a close look at the reasons of decrease of oxygen feeding.

In process of absorption of carbon dioxide and combustion products in the mixing chamber 218 carbonic acid appears, and accordingly pH index of water fed into the cyclone 106 may be changed. Processes of carbon dioxide of desorption in the cyclone 106 and water decarbonation in the calcic decarbonator 112 may depend on this index.

In case of low pH index value due to carbon dioxide desorption in the cyclone 106 pressure in the gas path 103 may increase that may lead to discharge of combustions products through the regulator 110 into environment. Depending on the pH index value, with account of pH decrease due to formation of carbonic acid, when it reaches a preset value alkali from the reservoir 113 with alkali liquor may be fed into the mixing chamber 218 of the jet module 102 through the measuring valve 114, forming salt and water in interaction with carbonic acid and at the same time increasing pH to the set value. In this case water decarbonization may be achieved without pressure increase in the gas path 103 and without carbonate dissolving in the calcic decarbonator 112.

Based on results of already conducted experiments, it may possible to reduce the specific fuel consumption per unit of produced heat power by no less than 10%, and under optimal conditions this reduction may be no less than 15%, using a method as described above. Creation of a compact, efficient, and ecologically sound unit for water heating and hot water supply systems, which at oxygen use as an oxidizing compound slightly discharge carbon dioxide into environment, was finally achieved. In case of air use as an oxidizing compound some carbon dioxide formed at hydrocarbon fuel combustion may be discharged into atmosphere along with nitrogen, because in this case carbon dioxide in combustion products is diluted by air components (nitrogen and argon), which do not take part in fuel combustion.

An excessive volume of combustion products in air and low concentration of harmful gases (carbon and sulfur dioxides) in them may not allow using water as an active medium in the apparatus for combustion residue recovering and heat generating, because a correspondingly large water discharge may be required for operation of jet modules.

Figure 3:
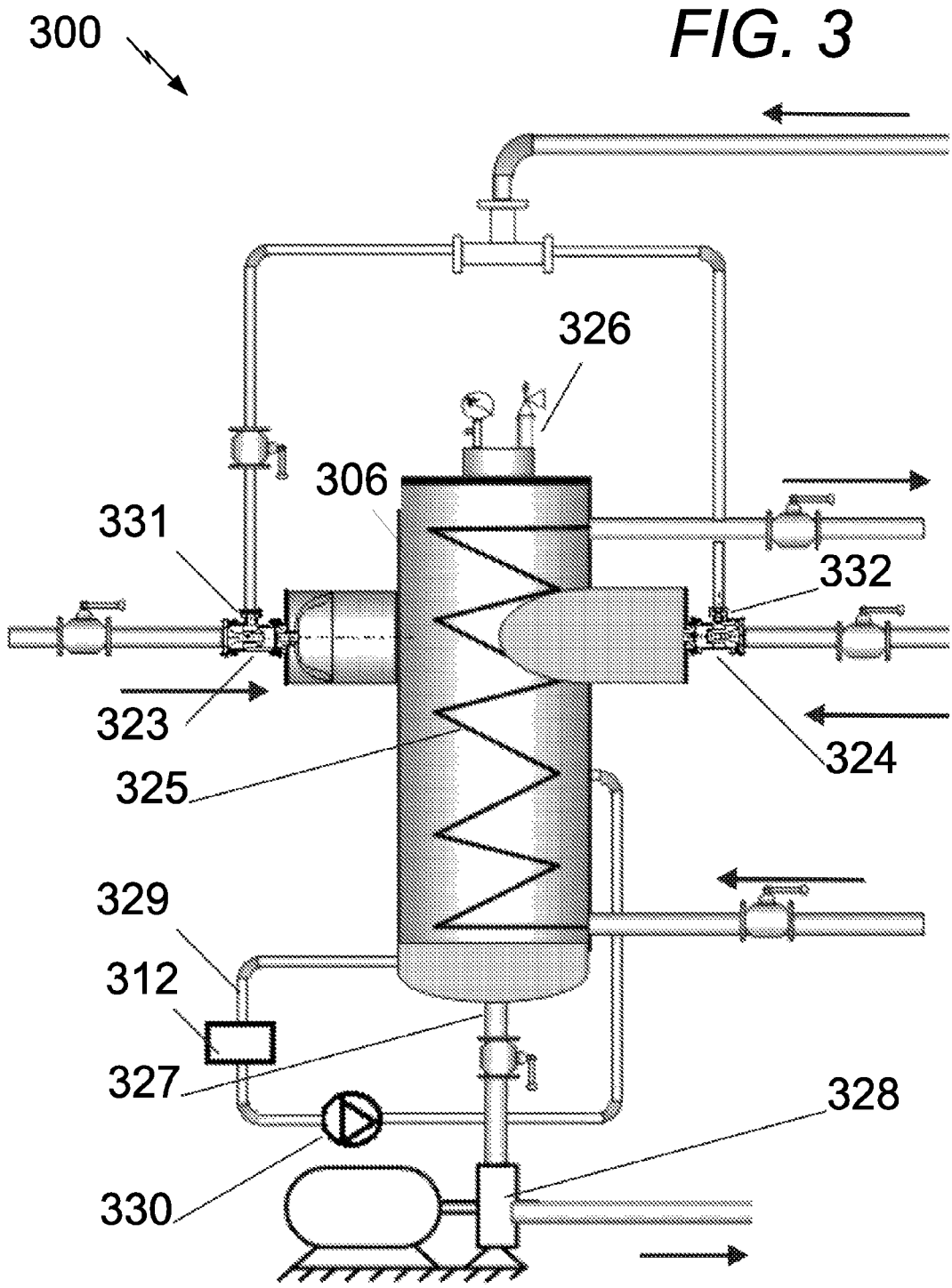
FIG. 3 is a schematic diagram showing a system for recovering impurities from combustion gases, including a TJM, separator, and other components, in which end products of fuel combustion are used as the active medium.

An example of an alternative apparatus 300 is shown schematically in FIG. 3, for use with combustion products making up the active medium to the transonic jet module.

The apparatus 300 may include the first transonic jet module 323 and the second transonic jet module 324 both connected to the separator from the opposite sides with possibility of unidirectional rotation of streams from the first and the second apparatuses. Accordingly, the separator may be configured in the form of a cyclone 306. The cyclone in this apparatus may include a heat exchanger 326 connected to the independent circuit for heating the medium flowing through it. This cyclone may have a gas outlet 326 and a water outlet 327 connected through the pump 328 to the line of recovering of harmful impurities found in the water phase.

Further a calcium decarbonator 312 may connected to the cyclone separator by means of the circulation pipeline 329 supplied with a pump 330. A line 333 for pure water feeding may be connected to the inlets 331, 332 for passive mediums of the jet modules 323, 324.

Figure 4:
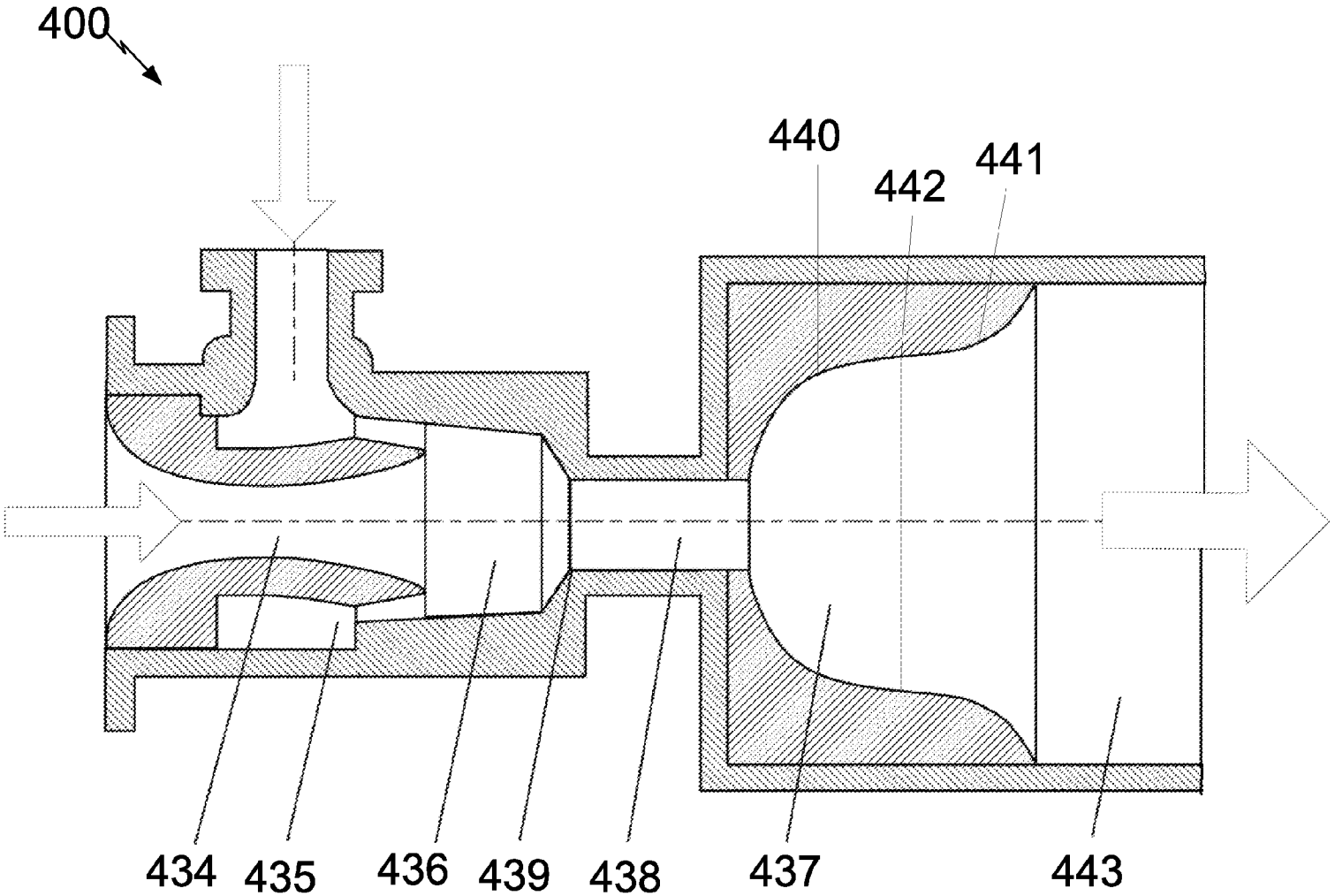
FIG. 4 represents a longitudinal section of the transonic jet module with the main nozzle in the form of the Laval nozzle and with an additional nozzle in the form of Fisenko nozzle, for use with the system shown in FIG. 3.

The jet modules 323, 324, which longitudinal section is shown in FIG. 4 at 400, include the main nozzle 434 for active medium (for example combustion products) configured in the form of the Laval nozzle, an annular nozzle (the second nozzle) 435 for water used as a passive medium, a mixing chamber 436, an additional nozzle (the third nozzle) 437 with the inlet section configured in the form of a cylindrical continuation of the channel 438 with length from 0.5 to 1 its diameter connected to the outlet divergent section.

The jet modules 323, 324 may be provided with a sharp edge 439 located in the zone of the mixing chamber 436 connection to the cylindrical channel 438. The additional nozzle 437 configured in the form of the Fisenko nozzle may have a profile of the outlet section the same as the main nozzle 217 in the apparatus 100, which scheme is shown in FIG. 1. Namely, the geometrical profile of the divergent outlet section of the nozzle may be formed of the nozzle's part 442 concave towards the axis of the nozzle, which smoothly changes into the convex one 441, at this the critical section 442 of the nozzle where the stream velocity is equal to the sound velocity is located in the outlet section of the additional nozzle 437. The outlet section of the additional nozzle 437 also may have an outlet cylindrical part 443 connected with the convex part 441 of the outlet section.

For combustion residue recovering in air, the apparatus 300 shown in FIG. 3 may be used, and operated as follows.

Hot combustion products under pressure exceeding the atmospheric pressure are fed to the inlets for active medium and into the main nozzles of the jet modules 323, 324; and cold water purified of harmful impurities incorporated in combustion products may be fed to the inlets 331, 332 for passive medium.

Combustion products are accelerated to the supersonic velocity in the nozzle 434 configured in the form of the Laval nozzle; and water may be accelerated in the annular nozzle 435. In the mixing chamber 436 streams of water and combustion products are mixed with formation of gas-liquid mixture.

Accordingly, water may be heated by the hot combustion products and partially evaporates with formation of vapor-gas mixture with drops of water. In the mixing chamber 436 and especially in the zone of connection of the chamber 436 with the cylindrical channel 438, sudden changes of compacting may appear, the gas-liquid stream may be decelerated, and pressure in the stream may increase.

In the areas of increased pressure appeared due to sudden changes of compacting, vapor formed at heating and evaporating of water condenses, and harmful impurities (carbon and sulfur dioxides) are partially dissolved in water. To increase carbon and sulfur dioxides dissolvability in water alkali liquor may be fed into the chamber 436 all the same as it is in the apparatus, which scheme is shown in FIG. 1.

Stream separation from the walls of the cylindrical channel 438 occurs on the sharp edge, and pressure in the stream decreases. Due to this water in drops heated in the mixing chamber 436 adiabatically boils, and microscopic vapor bubbles are formed in the drops.

When gas-liquid stream is fed into divergent section 437 of the nozzle adiabatic boiling of water in drops may be continued due to pressure decrease at the stream expansion. As a result the gas-liquid stream may be accelerated to supersonic velocity with formation of homogenous mist-like medium, the sizes of particles of which are smaller than the length of their free run. This process may be similar to the one occurring in the nozzle 217 at operation of the apparatus shown in FIG. 1.

A large number (e.g., majority) of small drops in the mist-like medium may provide a very large surface/volume ratio for contact between gas and water that assists carbon and sulfur dioxides dissolving in water. At the stream discharge from the nozzle 437 into the cylindrical channel 443, the stream in this channel may be decelerated to subsonic velocity with formation of sudden change of compacting, in which pressure increases.

Due to pressure increase in the sudden change of compacting carbon and sulfur dioxides are additionally dissolved in small water drops in the mist-like medium or in alkali liquor drops if such a liquor has been fed into the mixing chamber 436. Accordingly, in the sudden change of compacting, vapor may be partially transformed into gas-liquid medium with big water drops, which may contain small vapor bubbles.

At gas-liquid stream discharge to the cyclone from one or two jet modules 323, 324 the stream rotating along the walls may be formed in the cyclone, separation of gas from liquid occurs in this stream due to centrifugal force. Gas partially purified of carbon and sulfur dioxides may be deleted from the cyclone through the gas outlet 326.

Water with carbon and sulfur dioxides dissolved in it comes down along the walls of the cyclone and may be removed from it through the water outlet 327 using the pump 328 into the line for treatment (e.g., removal, recovery, or utilization in another process) of harmful impurities found in water. Accordingly, processes similar to those in the cyclone operating in the apparatus 100 shown in FIG. 1 occur in water.

To reduce carbon and sulfur dioxides desorption it may be also possible to increase pH for liquid medium by adding alkali liquor and partially purify water of carbon and sulfur dioxides by means of its pumping by the pump 330 along the circulating pipeline 329 through the calcium (or other reactant) decarbonator 312.

To reduce carbon and sulfur dioxides desorption from water in the cyclone separator, water may be cooled using the heat exchanger 325 connected to an independent consumer. When pressure in the cyclone is close to the atmospheric temperatures of gas and water after their separation may be close to the dew-point temperature which may be, for example, 60-70° C.

Heat carrier in the heat exchanger 325 may be heated up to this temperature. However, to improve the process of harmful impurities removal from combustion products cold water may be fed into this heat exchanger for cooling gas-liquid mixture in the cyclone. In this case heat generation in the apparatus may decrease and degree of combustion products purification from harmful impurities may increase.

In the apparatus 300 shown in FIG. 3, heat incorporated in combustion products may be effectively transformed into kinetic energy of gas-liquid stream, which is spent for formation of a mist-like medium with a high surface/volume ratio for water and gas contact. This assists dissolving of harmful impurities in water.

In general, operation of the apparatus 100 or apparatus 300 may be according to the methods described above. In addition, a method 500 as diagrammed in FIG. 5 is provided as a general example of a method having aspects capable of being performed using either apparatus.

The method 500 may include, at 502, passing an active medium supplied to a first inlet of a transonic jet module through a main nozzle into a mixing chamber. The method may further include, at 504, passing a passive medium supplied to a second inlet of the transonic jet module through a secondary nozzle into the mixing chamber, the secondary nozzle being an annular converging-diverging nozzle coaxial with and encircling the main nozzle. The method 500 may further include, at 506, discharging a mixture of the active medium and the passive medium from the mixing chamber from an outlet of the transonic jet module into a gas-liquid phase separator. The method 500 may further include, at 508, recovering a carbon-enriched liquid product stream from a liquid outlet of the gas-liquid separator. The method may further include, at 510, treating carbon in the carbon-enriched liquid stream; for example reacting with calcium or other reactant to form a carbonate salt.

In related aspects of the method 500, the active medium may consist essentially of water supplied in a liquid form at the first inlet, and the passive medium may consists essentially of a fuel combustion residue supplied as a vapor-gas-liquid mixture at the second inlet. In this aspect, an apparatus 100 as shown in FIG. 1 may be used to perform the method 500, and further aspects of the method 500 may be in accordance with the apparatus and operation details discussed above mainly (but not exclusively) in connection with FIGS. 1 and 2. In this case, the method 500 may further include boiling the active medium in a convergent inlet section of the main nozzle using a sharp-edged multistage reduction of inner diameter, and expanding the active medium in the divergent outlet section of the main nozzle using a concave profile relative to a central longitudinal axis of the main nozzle in an initial portion just downstream of the inlet section that smoothly transitions to a convex profile at a critical section of the main nozzle located in the outlet section where the active medium reaches a transonic stream velocity.

In an alternative aspect of the method 500, the active medium may consists essentially of a fuel combustion residue supplied as a vapor-gas-liquid mixture at the first inlet, and the passive medium may consist essentially of water supplied in a liquid form at the second inlet. In this alternative aspect, an apparatus 300 as shown in FIG. 3 may be used to perform the method 500, and further aspects of the method 500 may be in accordance with the apparatus and operation details discussed above mainly (but not exclusively) in connection with FIGS. 3 and 4. For example, the method may include discharging the mixture through a third nozzle coupled to the mixing chamber, the third nozzle comprising a cylindrical inlet section coupled to a divergent outlet section, wherein the outlet section has a concave profile relative to a central longitudinal axis of the nozzle in an initial portion just downstream of the inlet section that smoothly transitions to a convex profile at a critical section of the nozzle located in the outlet section, the critical section being defined by a transonic stream velocity. In this case, the method 500 may further include mixing the primary medium and the secondary using a second transonic jet module coupled to the gas-liquid separator opposite to the transonic jet module, and discharging the mixture to cause unidirectional rotation of a gas-liquid mixture admitted to the gas-liquid separator. The method 500 may further include heating a fluid medium in the gas-liquid separator using a heat exchanger coupled to an independent circuit.

In other, more general aspects, the method 500 may include removing carbonic impurities from the liquid product stream, using a decarbonator coupled to the liquid outlet of the gas-liquid separator. In addition, or in an alternative, the method 500 may include dispensing an alkali material to at least one of the mixing chamber or the gas-liquid separator via a dispensing valve. In another general aspect, passing the passive medium through the secondary nozzle causes transonic flow to occur in the secondary nozzle. The method 500 may include other, more detailed aspects and operations as described herein, which should be apparent elsewhere in the present disclosure.

Therefore, the applied apparatus may be used for utilization or removal of gaseous discharges (vapor and/or gas mixtures) incorporating harmful impurities both connected with burning and not connected with it. Accordingly, the applied apparatus may provide advantages for recovery and/or utilization of combustion products of heat power plants (coal, gas, residual, peat coal, working on organic fuel, etc.), boiler plants, big internal-combustion engines' exhaust, and also automobile exhausts. In addition, the apparatus may be applied for recovery or utilization of combustion products at metal fabrication. Use of the present technology may enable solving a group of problems related to pollution control and preventing inefficient use of resources, by obtaining useful material while removing harmful impurities from the discharge of combustion processes, and recovering heat from the utilization/treatment process.

The previous description of the disclosed aspects is provided to enable any person skilled in the art to make or use the present disclosure. Various modifications to these aspects will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The foregoing embodiments merely exemplify various apparatus and systems for combustion products utilization and heat generation using multiple nozzles. The present technology is not limited by these examples.

What is claimed is:

1. A method for combustion residue recovering and heat generating, the method comprising:

passing an active medium supplied to a first inlet of a transonic jet module through a main nozzle into a mixing chamber;

passing a passive medium supplied to a second inlet of the transonic jet module through a secondary nozzle into the mixing chamber, the secondary nozzle being an annular converging-diverging nozzle coaxial with and encircling the main nozzle;

discharging a mixture of the active medium and the passive medium from the mixing chamber from an outlet of the transonic jet module into a gas-liquid phase separator;

recovering a carbon-enriched liquid product stream from a liquid outlet of the gas-liquid separator; and treating carbon in the carbon-enriched liquid stream.

2. The method according to claim 1, wherein the active medium consists essentially of water supplied in a liquid form at the first inlet, and the passive medium consists essentially of a fuel combustion residue supplied as a vapor-gas-liquid mixture at the second inlet.

3. The method according to claim 1, wherein the active medium consists essentially of a fuel combustion residue supplied as a vapor-gas-liquid mixture at the first inlet, and the passive medium consists essentially of water supplied in a liquid form at the second inlet.

4. The method according to claim 1, further comprising removing carbonic impurities from the liquid product stream, using a decarbonator coupled to the liquid outlet of the gas-liquid separator.

5. The method according to claim 1, further comprising dispensing an alkali material to at least one of the mixing chamber or the gas-liquid separator via a dispensing valve.

6. The method according to claim 1, wherein passing the passive medium through the secondary nozzle causes transonic flow to occur in the secondary nozzle.

7. The method according to claim 2, further comprising discharging the mixture through a third nozzle coupled to the mixing chamber, the third nozzle comprising a cylindrical inlet section coupled to a divergent outlet section, wherein the outlet section has a concave profile relative to a central longitudinal axis of the nozzle in an initial portion just downstream of the inlet section that smoothly transitions to a convex profile at a critical section of the nozzle located in the outlet section, the critical section being defined by a transonic stream velocity.

8. The method according to claim 1, further mixing the primary medium and the secondary using a second transonic jet module coupled to the gas-liquid separator opposite to the transonic jet module, and discharging the mixture to cause unidirectional rotation of a gas-liquid mixture admitted to the gas-liquid separator.

9. The method according to claim 1, further comprising heating a fluid medium in the gas-liquid separator using a heat exchanger coupled to an independent circuit.

10. The method according to claim 3, further comprising boiling the active medium in a convergent inlet section of the main nozzle using a sharp-edged multistage reduction of inner diameter, and expanding the active medium in the divergent outlet section of the main nozzle using a concave profile relative to a central longitudinal axis of the main nozzle in an initial portion just downstream of the inlet section that smoothly transitions to a convex profile at a critical section of the main nozzle located in the outlet section where the active medium reaches a transonic stream velocity.

* * * * *